US005431358A

United States Patent [19]

Alexander, III

[11] Patent Number: 5,431,358

[45] Date of Patent: Jul. 11, 1995

[54] WEB ROLL SUPPORT APPARATUS AND METHOD

[76] Inventor: William J. Alexander, III, P.O. Box 848, Mauldin, S.C. 29662

[21] Appl. No.: 96,406

[22] Filed: Jul. 26, 1993

[51] Int. Cl.[6] ..... B65H 18/20; B65H 16/08

[52] U.S. Cl. ..... 242/542; 242/542.4; 242/564.5

[58] Field of Search ..... 242/542.4, 542, 542.1, 242/542.2, 547, 564.5

[56] References Cited

U.S. PATENT DOCUMENTS

| | | | |
|---|---|---|---|
| 1,093,913 | 4/1914 | Church . | |
| 1,355,106 | 10/1920 | Johnstone | 242/542.4 |
| 1,355,107 | 10/1920 | Johnstone | 242/542.4 |
| 1,738,170 | 12/1929 | Cohen . | |
| 1,967,922 | 7/1934 | Cameron | 242/542.4 |
| 1,984,784 | 12/1934 | Cameron | 242/542.4 |
| 2,461,387 | 2/1949 | Medbery | 242/542.4 |
| 3,239,163 | 3/1966 | Ciniglio . | |
| 3,240,442 | 3/1966 | Kilmartin | 242/542.4 |
| 3,433,429 | 3/1969 | Schnitzspahn . | |
| 3,541,600 | 11/1970 | Martin | 242/542.4 |
| 3,561,692 | 2/1971 | Henry | 242/542.4 |
| 4,026,487 | 5/1977 | Ales . | |
| 5,289,087 | 2/1994 | Summey | 242/542.1 |

*Primary Examiner*—John M. Jillions
*Attorney, Agent, or Firm*—Ralph Bailey

[57] ABSTRACT

A roll (A) for surface winding and dewinding a web utilizes a raised surface (B) which is divided by recesses into a plurality of raised areas carried by spaced protuberances (C) fixed to the metallic roll defining base portions (D) therebetween so that the roll may be driven so as to avoid wrinkles and with varying packing ratios.

3 Claims, 2 Drawing Sheets

WEB ROLL SUPPORT APPARATUS AND METHOD

BACKGROUND OF THE INVENTION

This invention relates to surface winding and unwinding of cloth or plastic webs and the like from web rolls, and more particularly to support rolls having raised areas arranged discontinuously thereon for preventing wrinkles, indentations and uneven tensioning of the webs.

Many efforts have been made to avoid wrinkling of cloth being unwound from rolls on surface winders and unwinders, batchers, cradle let-offs and the like. In the area where the support rolls engage the cloth roll, the cloth roll is indented presenting a shorter cloth roll radius at that point than the radius in the unengaged areas of the roll resulting in the formation of a bulge or bagging down in advance of the support roll. Sometimes, the bulge or loose pucker resulting from such bagging down advances entirely about the wound roll causing wrinkling, marking and uneven tension.

U.S. Pat. Nos. 1,738,170, 3,433,429 and 4,026,487 illustrate effort to solve the problem through compressible support roll coverings wherein an effort is made to match the compressibility of the support roll to the compressibility of the wound web roll. An inflatable support roll covering is illustrated in Canadian Patent No. 653,299. Other efforts to solve the problem include uniform or continuously spaced fluting on the support rolls. Such fluting may be skewed or spiralled in respect to the longitudinal axis. A roll having spaced segments is illustrated in U.S. Pat. No. 1,093,913, whereas U.S. Pat. No. 3,239,163 illustrates uniformly spaced compressible fluting having upper surface areas conforming to the curvature of the flexible roll.

Attempts to match or otherwise utilize the relative compressibility of the support rolls in relation to the compressibility of the wound rolls have met with limited success. Fluted rolls having uniform circumferential spacing result in vibration or and chattering and sometimes mark the wound rolls with the pattern of the fluted segments due to the limited areas of support offered thereby.

Because of the problems outlined above, there is no cloth winder in common use which is also capable of unwinding.

SUMMARY OF THE INVENTION

Accordingly, it is an important object of this invention to provide an improved support roll and method of surface winding and unwinding of a web from a web roll avoiding the problem of wrinkling and marking of the web.

Another object of the present invention is the provision of a support roll for use in surface winding and unwinding a web wherein raised areas are provided on the support roll which are so spaced discontinuously or randomly as to provide recesses in which the web may gather to avoid the build up of wrinkles which detract from the appearance of and induce uneven tension in the wound roll.

The method contemplates using a support roll having discontinuously spaced raised areas while providing variable packing ratios between the support rolls for winding and dewinding modes.

The apparatus includes a pair of spaced elongated metallic rolls supporting the web roll. A plurality of raised areas form a raised surface constructed of material, preferably somewhat softer than steel fixed to the metallic roll and extending discontinuously from the metallic roll. It has been found that such raised areas having a Durometer hardness of about 60 produce satisfactory results. The raised surface is of sufficient area and hardness to support the web roll during winding providing smooth transition between protuberances without excessive marking of the web while maintaining spaces between the raised areas. Drive means for the rolls provide an adjustable packing ratio between the first and second rolls receiving the web during winding and dewinding. Means are provided for varying the packing ratio wherein one of said rolls is a drive roll and one of said rolls is a packing roll to provide a desired packing ratio during winding or unwinding.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
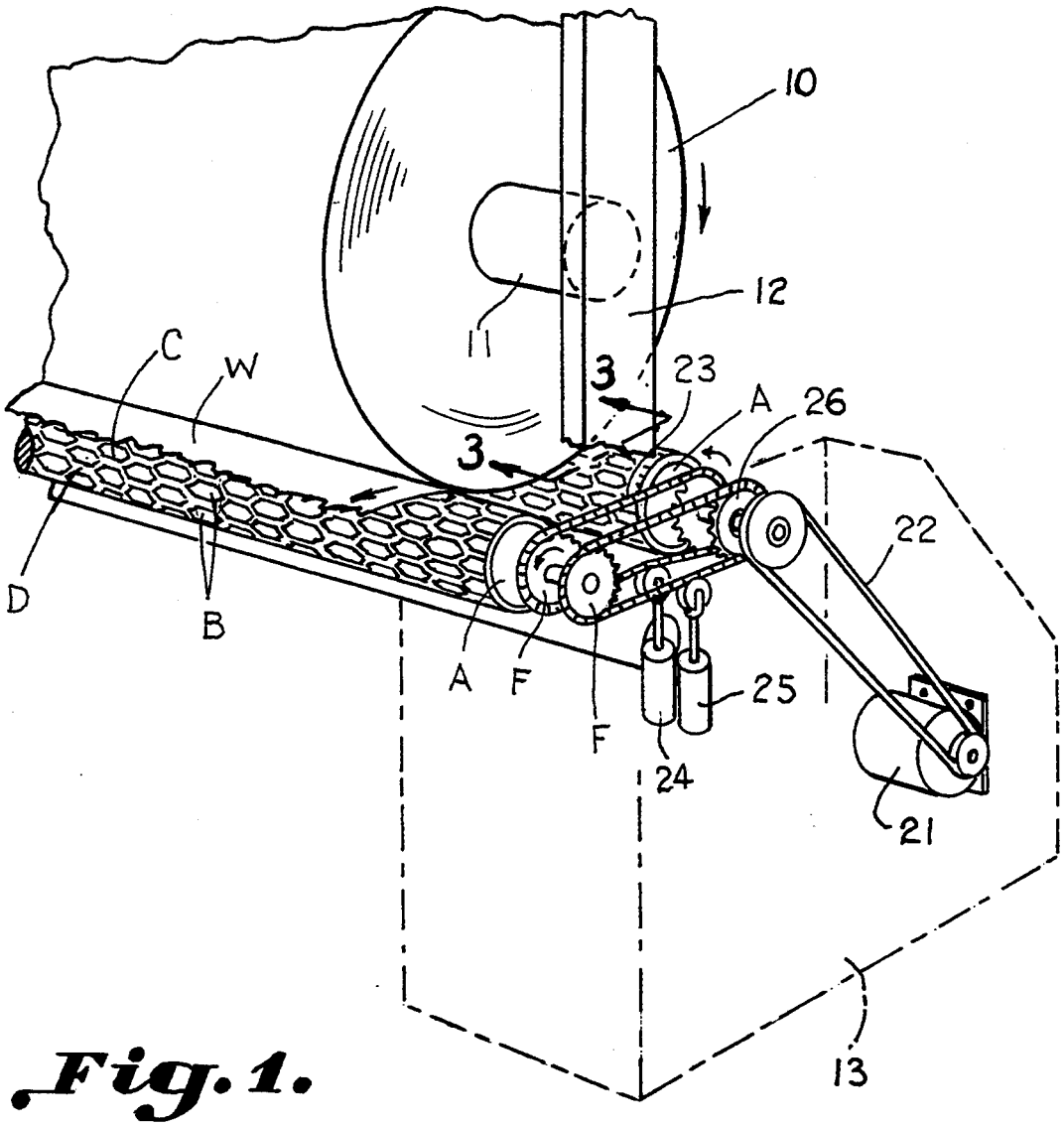
FIG. 1 is a perspective view illustrating a surface winder equipped with rolls, constructed in accordance with the invention, having raised areas arranged discontinuously thereon.

The drawings illustrate a roll for use in apparatus for surface winding and dewinding a web roll upon a core and includes an elongated preferably metallic roll A which supports the wound roll during the build and during dewinding. A raised surface B is carried by the metallic roll. A plurality of raised areas forming the raised surface are carried by spaced protuberances C. The protuberances are constructed of material fixed to the metallic roll defining recesses having lower base portions D therebetween. The protuberances and the recesses between them extend discontinuously about the surface of the metallic roll so as to run smoothly without chattering. The raised surface conforms generally to the curvature of the rolls and is of sufficient area and hardness to support the roll of web material formed thereon during winding and dewinding while maintaining the recesses between the raised areas of the roll. Thus, the web is gripped by the raised areas and received in the spaces during winding and dewinding so as to avoid wrinkles and uneven tension in the web. The raised areas may extend discontinuously longitudinally of the support roll as well as discontinuously circumferentially of the roll as in staggered relation.

Preferably, apparatus for surface winding and dewinding a web upon a core is provided wherein a pair of such spaced elongated metallic rolls A support the core and the web wound thereon. Each roll has a raised surface B carried by the metallic rolls having a plurality of raised areas forming the raised surface and being constructed of somewhat deformable material fixed to the metallic roll extending discontinuously about the surface of the metallic roll. The raised surface is of sufficient area and hardness to support the core and roll of web material formed thereon during winding and dewinding without excessive marking of the web while maintaining spaces between the raised areas. A first drive E for the rolls provides a packing ratio wherein a second roll may be driven slightly faster than a first roll receiving the web during winding. A second drive F for the rolls provides a variable drive wherein a substantially equal drive speed is imparted to the rolls as during dewinding. If desired, the drive for the rolls may be infinitely variable. If desired, the rolls of the invention may be used on dewinders only.

Thus, the web is gripped by the raised areas and received in the spaces during winding and dewinding as to avoid wrinkles and uneven tension in the web while supporting the web roll. Means are preferably included for varying a packing ratio wherein one of the rolls is a drive roll and one of said rolls is a packing roll to provide a desired packing ratio when winding or dewinding. Usually during winding the packing ratio is positive while during dewinding the packing ratio would be one to one or one of the rolls may freewheel. During winding the tendency to indent the roll works in a desirable way while such tendency with the resultant bulge works disadvantageously during dewinding. The method of surface winding and dewinding a web upon a core contemplates supporting the core and the web wound thereon between rolls A consisting of a drive roll and a packing roll providing a raised surface B on the rolls by forming same of somewhat deformable material fixed to the metallic roll extending longitudinally of the metallic roll and making the raised areas on said raised surface to generally conform to the curvature of the rolls and of sufficient surface area and hardness to support the core and roll of web material formed thereon during winding while maintaining spaces between the raised areas. By providing a variable packing ratio between the drive roll and the packing roll, wrinkles and uneven build and unwinding of the web roll may be avoided.

Figure 3:
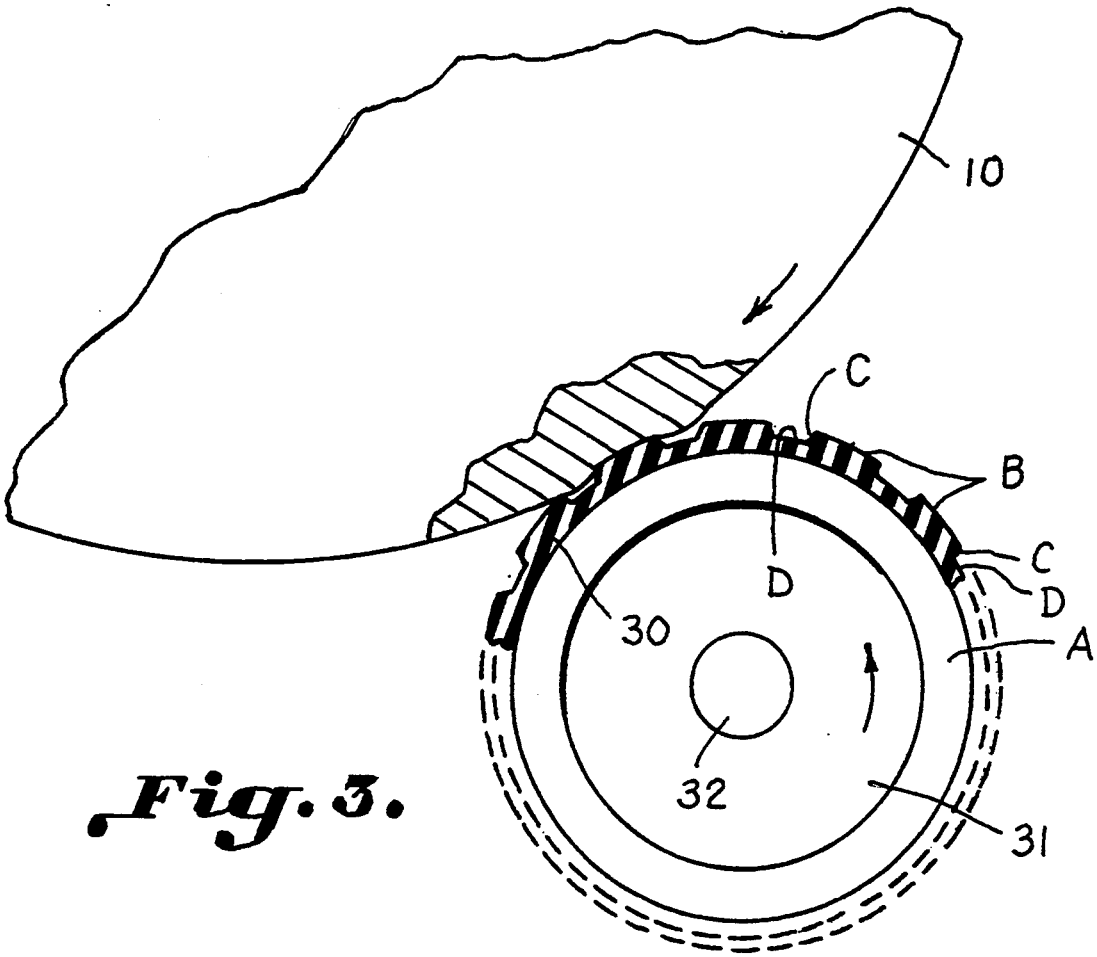
FIG. 3 is an end view, taken on the line 3—3 in FIG. 1, illustrating the construction of a support roll having raised areas constructed in accordance with the invention.

Referring to FIG. 3, a wound web roll 10 is illustrated as being carried upon support rolls A as for a surface dewinding operation. In FIG. 1 the web roll 10 is illustrated as being carried upon a core 11 between end members 12 which limit the longitudinal movement of the web roll upon the support rolls A during unwinding. The upright end members 12 are carried by a suitable frame illustrated in broken lines at 13.

The motor 21 through the belt 22 drives a first drive E which includes the chain 23 so that the support roll A on the left hand side in FIG. 1 acts as a drive roll while the other support roll on the right acts as a packing roll. The cylinder 24 has its piston rod extended so as to actuate the drive mechanism E. Alternatively, the cylinder 25 may be actuated upon deactivation of the first mentioned cylinder 24 so as to operate the drive mechanism F which includes the chain 26.

Any of a number of available devices may be utilized to vary the packing ratio, the above being exemplary. Another example of suitable apparatus is illustrated in co-pending patent application Ser. No. 07/970,259 now U.S. Pat. No. 5,284,087 entitled SURFACE WINDER DRIVE AND METHOD filed Nov. 2, 1992, the disclosure of which is included herein by reference.

Figure 2:
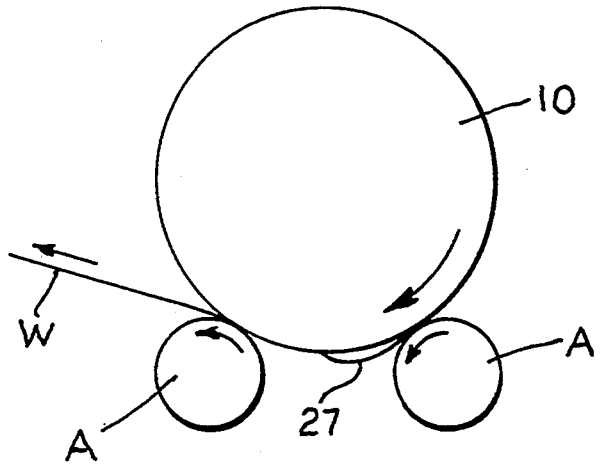
PRIOR ART Fig. 2.
FIG. 2 is an end view illustrating an unwinding operation in accordance with the prior art wherein a bulge is created between support rolls in advance of the roll on the right.

The prior art is illustrated in FIG. 2 wherein the formation of a bulge 27 is illustrated between the support rolls A in an unwinding or dewinding operation. The bulge takes place in advance of the packing roll on the right. The web W is illustrated as positioned for delivery during unwinding.

Figure 4:
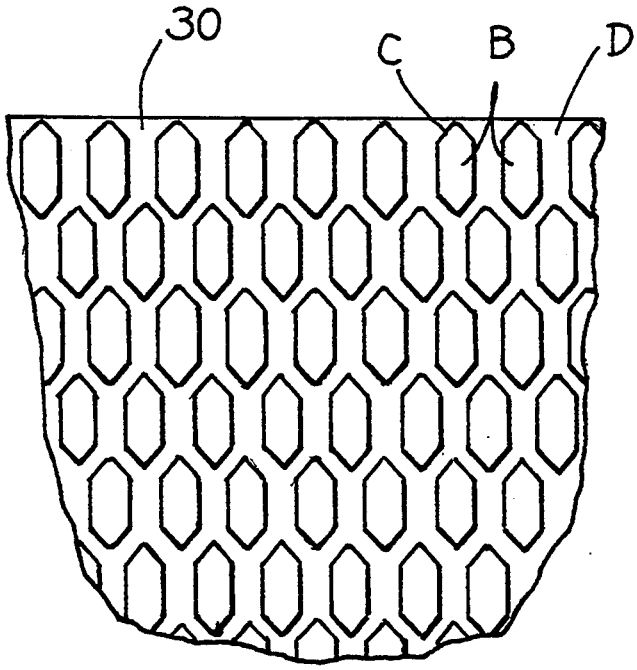
FIG. 4 is a developed view of the pattern of the placement of the protuberances carrying raised areas, having sufficient surface area to provide the necessary support for the wound roll without excessive marking, on the periphery of the support rolls in accordance with a preferred embodiment of the invention illustrating discontinuity in the spacing of the raised areas both circumferentially and longitudinally of the roll.

FIGS. 3 and 4 illustrate a suitable discontinuous pattern of raised areas in the surface B carried upon the protuberances C. The steel support roll A is cylindrical and is illustrated as carrying a cover 30 thereon which may be constructed of material of sufficient hardness to provide for securement or positioning of compressible protuberances on the roll A for engaging cloth or other web material as it is being wound while the other support roll A is acting as a packing roll. The roll A is illustrated as including end members 31 and a drive shaft 32.

It will be noted that base areas D are arranged between the protuberances C and they, together with the edges of the protuberances, define spacing or recessing between the raised areas of the surface B.

The raised areas of the surface B are illustrated as being elongated and octagonal and are positioned in spaced relation circumferentially and longitudinally and being in alternately spaced relation in rows providing discontinuity longitudinally and circumferentially as illustrated in FIG. 4.

It is best seen by reference to FIG. 3 that the web roll is engaged by the support rolls in such a way as to offer suitable areas of support while providing recesses wherein the bulge or gathers resulting from the compression and limited contact of the support rolls during winding or dewinding operation may be relieved.

While a preferred embodiment of the invention has been described using specific terms, such description is for illustrative purposes only, and it is to be understood that changes and variations may be made without departing from the spirit or scope of the following claims.

What is claimed is:

1. A roll for use in apparatus for surface winding and dewinding a web upon a core comprising:

an elongated roll supporting said core and said web wound thereon;

a raised surface carried by said roll;

a plurality of spaced protuberances fixed to the roll define lower base portions therebetween;

a plurality of discrete raised areas forming said raised surface carried by said spaced protuberances;

said protuberances and recesses between them extending discontinuously both longitudinally and circumferentially of said roll;

said raised areas and lower base portions being spaced both longitudinally and circumferentially avoiding any continuous groove substantially longitudinally or circumferentially on said support roll; and said raised surface conforming generally to the curvature of the roll and being of sufficient area to support said core and roll of web material formed thereon during winding and unwinding while maintaining said recesses between said raised areas of said roll;

whereby said web is gripped by said raised areas and received in said spaces during winding and dewinding as to avoid wrinkles and uneven tension in the web.

2. The structure set forth in claim 1 wherein said raised areas are carried in staggered relation longitudinally and circumferentially of the roll.

3. The method of winding and unwinding a cloth roll carried upon a core comprising the steps of:

providing a pair of horizontal support rolls positioned in alignment for carrying a cloth roll therebetween;

forming respective patterned surfaces including discrete raised areas and lower base portions therebetween upon said horizontal support rolls;

continuously presenting similar patterned surfaces to said cloth roll when winding and when unwinding cloth upon said cloth roll so that said rolls are non-directional;

spacing said raised areas and lower base portions both longitudinally and circumferentially on each of said horizontal support rolls avoiding any continuous groove substantially longitudinally or circumferentially on said support rolls;

driving said pair of horizontal support rolls in a direction for unwinding cloth from said cloth roll and then driving said pair of horizontal support rolls in the other direction for winding cloth upon said cloth roll; and guiding said core during winding and unwinding utilizing a pair of spaced upright core guides carried on respective ends of said cloth roll;

whereby cloth may be wound or unwound upon a cloth roll and may be alternately reversed in direction as when inspecting the cloth or otherwise as desired without gathering up as a result of said rolls being driven in either direction.

* * * * *